United States Patent [19]

March

[11] 4,121,679

[45] Oct. 24, 1978

[54] SELF-TRANSPORTING SUPPORT ARRANGEMENT

[76] Inventor: Adrian Anthony Cecil March, High Beeches, Swaineshill, Alton, Hampshire, GU34 4DP, England

[21] Appl. No.: 798,252

[22] Filed: May 18, 1977

[30] Foreign Application Priority Data

May 20, 1976 [GB] United Kingdom ..... 20853/76

[51] Int. Cl.[2] ..... B62D 57/02

[52] U.S. Cl. ..... 180/8 C; 244/50

[58] Field of Search ..... 180/7 R, 8 C, 124; 244/50

[56] References Cited

U.S. PATENT DOCUMENTS

| | | | |
|---|---|---|---|
| 3,537,540 | 11/1970 | Zuppiger | 180/8 C |
| 3,831,691 | 8/1974 | Jenkins | 180/8 C |

FOREIGN PATENT DOCUMENTS

| | | | |
|---|---|---|---|
| 1,215,456 | 12/1970 | United Kingdom | 180/8 C |
| 1,219,690 | 1/1970 | United Kingdom | 180/8 C |
| 1,302,535 | 1/1973 | United Kingdom | 180/8 C |

*Primary Examiner*—Joseph F. Peters, Jr.
*Assistant Examiner*—R. Schrencengost
*Attorney, Agent, or Firm*—Cushman, Darby & Cushman

[57] ABSTRACT

A self-transporting support arrangement particularly useful as a helicopter undercarriage is disclosed. Ground-engaging members, e.g. skids, have associated shoes, and horizontal and vertical force is applied simultaneously between them by a plurality of inflatable bags located between opposed inclined planar surfaces. When friction is overcome, the ground-engaging member slides across the ground, without lifting.

14 Claims, 9 Drawing Figures

SELF-TRANSPORTING SUPPORT ARRANGEMENT

BACKGROUND OF THE INVENTION

1. FIELD OF THE INVENTION

This invention relates to self-transporting support arrangements and is particularly, though not exclusively, applicable to helicopter undercarriages. The invention extends to a helicopter having such an undercarriage.

2. DESCRIPTION OF THE PRIOR ART

A skid undercarriage is widely used in helicopters, since it permits both normal and emergency landings, while keeping weight, cost and aerodynamic drag to a minimum. Once landed, however the aircraft requires additional equipment to be moved. On firm ground, wheels can be attached, and small helicopters can then be manhandled, while larger ones can be towed. On unprepared ground, however, typically either very large wheels have to be fitted or the aircraft has to be towed on its skids by a powerful tractor. Neither of these alternatives is convenient.

Self-transporting support arrangements, which work in a manner analogous to walking, are known in connection with large apparatus such as cranes and earth-working machines. These arrangements have large ground-contacting and load-supporting "feet" which can be moved horizontally and vertically relative to each other. Motion over the ground is achieved by transferring load onto a first "foot" (or set of "feet"), raising a second "foot" and moving it horizontally before putting it down again, whereupon the load is transferred to the second "foot" so that the first "foot" can be raised and moved horizontally. In one such proposal (British patent specification No. 1,215,456) a force acting obliquely to the vertical is applied to the "feet" by a pressure cylinder through a plurality of levers which are pivotally interconnected, so that the "foot" off which weight is being transferred slides over the ground surface as soon as the horizontal component of the applied force overcomes the friction between it and the ground.

SUMMARY OF THE INVENTION

It is an object of this invention to provide a self-transporting support arrangement which can be light and simple in construction, yet robust, and which applies both horizontal and vertical forces simultaneously so that movement occurs as soon as friction is overcome without lifting of the ground-contacting members. It is another object to provide such an arrangement which is suitable for use on uneven and unprepared ground while providing good stability, so that it is especially suitable for use as a helicopter undercarriage.

According to this invention, the self-transporting support arrangement has force applying means in the form of at least one inflatable flexible bag located between opposed surfaces respectively of the support member and the shoe, said opposed surfaces being generally inclined to the horizontal and the bag being arranged to roll on the said opposed surfaces when inflated. Thus when the bag is inflated, the support member slides over the base surface, e.g. the ground, when friction is overcome, while the bag rolls on the said opposed surfaces. Because the support member does not leave the ground, good stability is maintained.

Preferably the said opposed surfaces are parallel and planar. Suitably at least two bags are employed to move each slidable support member in each cirection, to provide forces acting at spaced apart points.

It is particularly preferred if the shoe is integrated with the support member in plan, i.e. is located between longitudinal ends of the support member and lies on this axis of the support member.

It has been found that a particularly useful form of bag is one having an inner inflatable chamber and an outer chamber in the form of a flexible inflatable tube extending around the inner chamber and lying between the inner chamber and the said opposed surfaces.

BRIEF DESCRIPTION OF THE DRAWINGS

Preferred embodiments of the invention will now be described by way of non-limitative example with reference to the accompanying drawings, in which.

DESCRIPTION OF THE PREFERRED EMBODIMENTS

Figure 1:
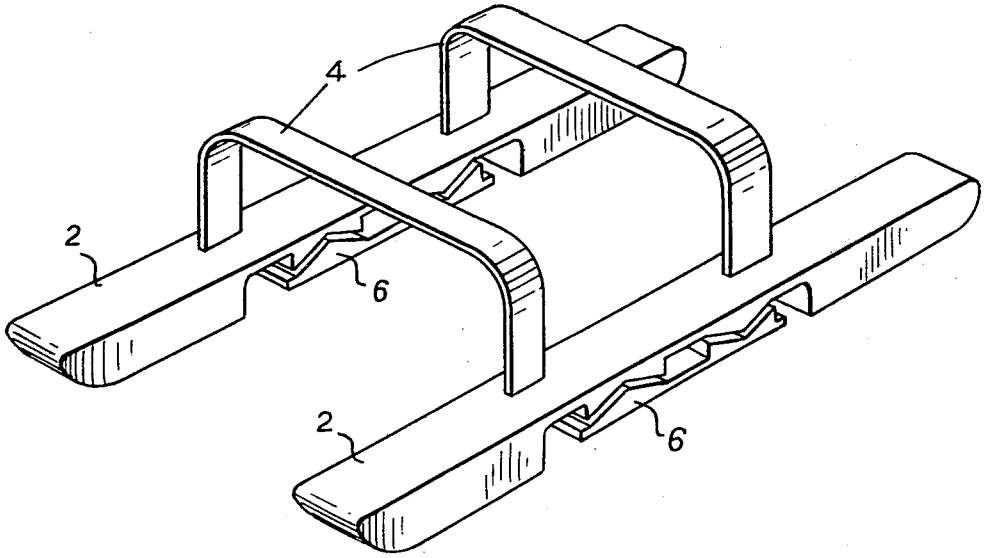
FIG. 1 is a perspective view of parts of a helicopter skid undercarriage embodying the invention.

The helicopter undercarriage of FIG. 1 has a pair of skids 2 having their longitudinal axes extending parallel to each other and to the longitudinal axis of the helicopter (not shown). The skids 2 are jointed by two transverse frames 4 to which the body structure of the helicopter is attached. In this embodiment a transport shoe 6 is integrated into each of the skids 2, i.e. the shoe 6 lies on the longitudinal axis of the skid 2 and between the ends of the skid 2. Preferably as here the skid has a larger ground contact area than the shoe 6. Alternatively, the transport shoes may be mounted alongside the skid, either inboard or outboard of the skid, or both, so that the skid is not interrupted.

Figure 2:
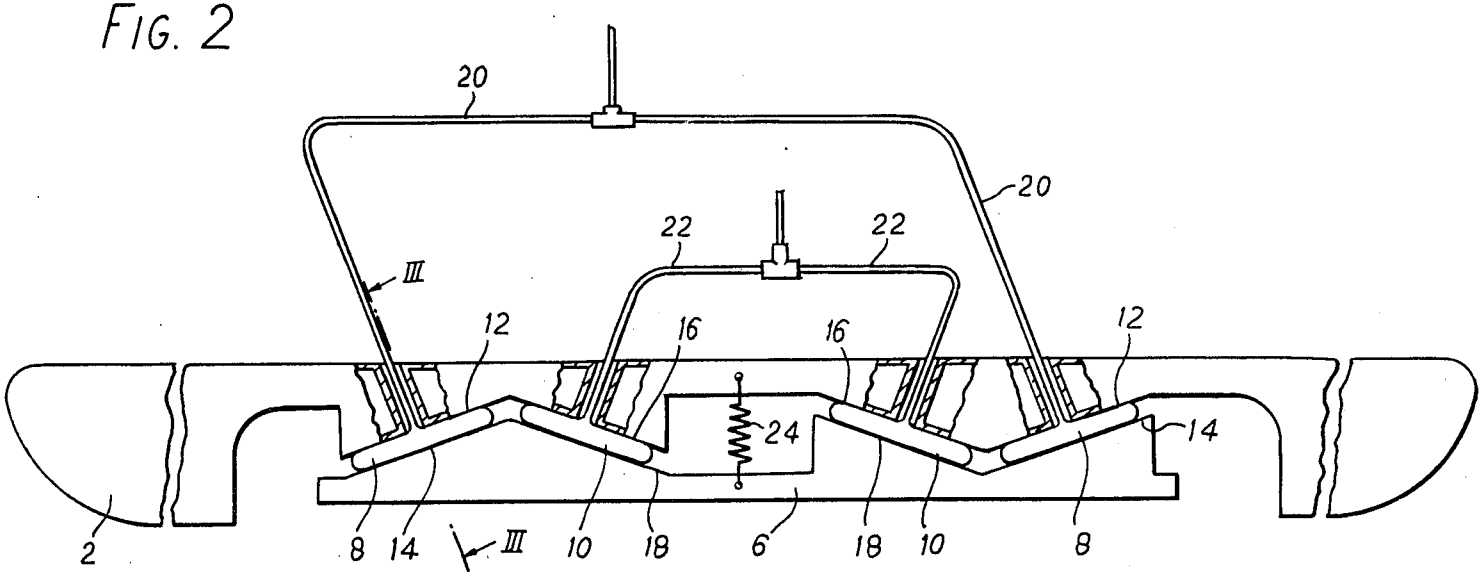
FIG. 2 is a longitudinal cross-section through one skid, and a shoe integrated therewith, of the undercarriage of FIG. 1.

The shoes 6 in FIG. 1 are adapted to propel the helicopter in either direction. Referring now to FIG. 2, which shows the skid 2 in detail, the propulsive force is provided by two pairs of inflatable flexible bags 8 and 10. Each bag lies between an inclined planar surface on the shoe 6 and an inclined planar surface on the skid 2, so that on inflation the bag urges these surfaces apart. The bags 8 which urge the skid 2 relatively to the left in FIG. 2 lie between the parallel opposed surfaces 12,14, which are inclined downwardly towards the left hand end of the skid 2. The bags 10 which urge the skid 2 relatively to the right lie between the parallel opposed surfaces 16,18 which are inclined downwardly towards the right. The bags are inflated and vented via pipes 20, and the bags 10 via pipes 22. A tension spring 24 secured at one end to the shoe 6 and at its other end to the skid 2 urges the shoe and skid towards each other. In the rest position, shown in FIG. 2, the ground-contacting surface of the shoe 6 is above the ground-contacting surface of the skid 2. The skid and shoe should be designed to minimize aerodynamic drag in flight, while providing adequate ground-contacting area. The skid 2 and shoe 6 are suitably formed as hollow tubes fabricated from sheet metal.

Figure 3:
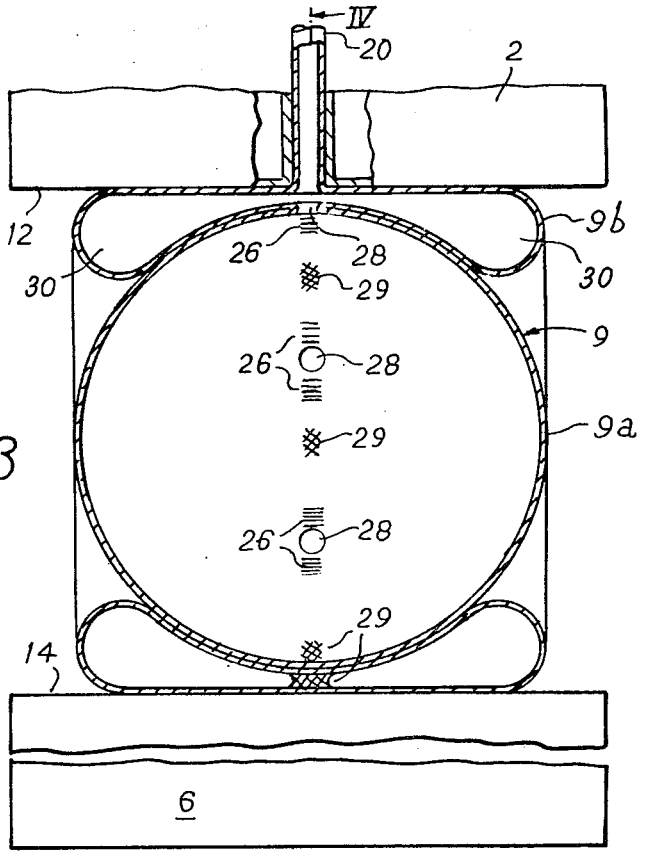
FIG. 3 is a partial cross-section on the line III—III of FIG. 2 showing an alternative form of the inflatable bag.
Figure 4:
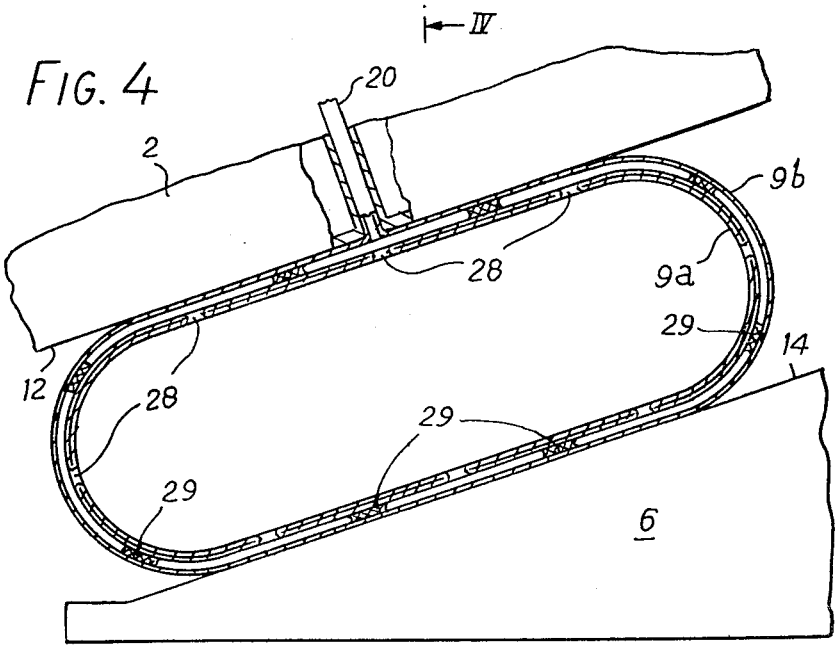
FIG. 4 is a partial cross-section on the line IV—IV of FIG. 3.

In the alternative embodiment illustrated in FIGS. 3 to 5, the skid 2 and shoe 6 are the same as in FIGS. 1 and 2, but the simple, single-chamber bags 8,10 of FIGS. 1 and 2 are replaced by two-chamber bags of a more complex shape, one such bag 9 being shown. FIG. 3 shows the surfaces 12,14 at maximum separation, while FIG. 4 shows the bag 9 in a partially inflated state. The aim of the design of the bag 9 is to maintain a large area in contact with the opposed inclined planar surfaces 12,14 or 16,18 even with a wide variation of separation between the opposed surfaces, while at the same time the bag should be able to roll a large distance as the surfaces 12,14 etc. move relatively in the horizontal direction. For instance the bag may be required to roll by a distance nearly equal to half the length of its perimeter. The flexible, inflatable bag 9 has an inner portion **9*a* which has a shape such that it can be inflated substantially into a sphere (if unhindered), and an outer portion 9b in the form of a tube extending circumferentially around the inner portion 9*a* so as always to lie between the inner portion 9*a* and the surfaces 12,14 in a manner similar to that of a pneumatic tire around a wheel. The two portions 9*a*, 9*b* are sealed together continuously, or as here at a number of spaced points 26, along an equator of the portion 9*a*. Additionally, in order to increase the stability of the inner portion 9*a* within the outer portion 9*b* when inflated, opposed areas of the interior surface of the outer portion 9*b* are secured together at a plurality of points 29 on the same equator line 26 (see FIGS. 3 and 4**).

Apertures 28 intercommunicate the air volumes within them, and the outer portion **9*b* is connected to the feed and vent pipe 20. In use, the outer portion 9*b* as seen in transverse section (FIG. 3) forms a lobe 30 on either side of the equator line 26**.

Figure 5A:
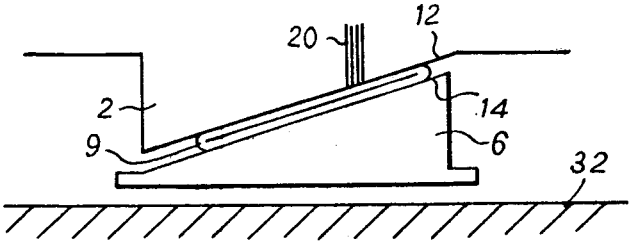
FIGS. 5*a* to 5*e* are diagrammatic side views of the bag of FIGS. 3 and 4 and the surfaces it engages, in various stages of operation.
Figure 5B:
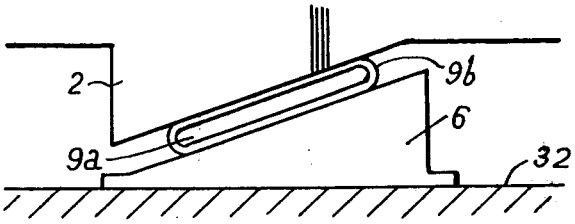
Figure 5C:
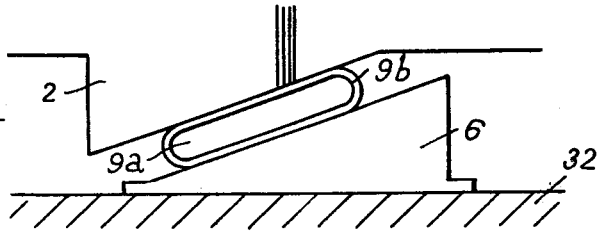
Figure 5D:
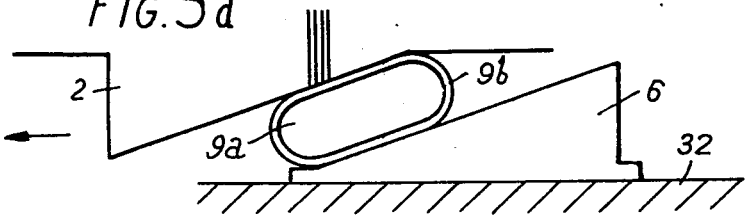
Figure 5E:
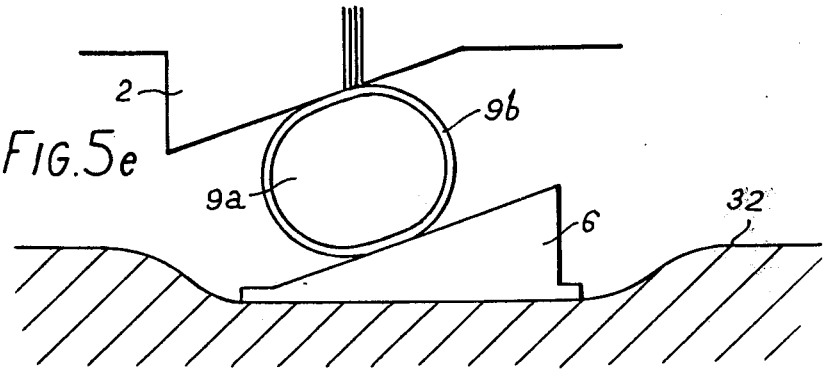

The two illustrated embodiments operate similarly, as shown in FIGS. **5*a* to 5*d*, where the skid 2 is shown resting on a ground surface 32. When the helicopter has landed on the surface 32, the skids 2 of the undercarriage support it on the ground and the spring 24 holds the bags 8,10 deflated and the shoe 6 off the ground (FIG. 5a). To move the helicopter to the left as seen in FIG. 5, the bags 8 are inflated so that the shoe 6** is moved into contact with the ground (FIG.5*b*). Further increase in pressure causes a force to be applied to the skid 2 at an angle to the vertical determined by the slope of the surfaces 12,14. When this force reaches the level such that its horizontal component overcomes the frictional force resisting movement of the skid 2, the skid slides along the ground (without losing contact) to the left (FIG. 5*c*). The bag 9, which is fixed to the surface 12 in the neighbourhood of the pipe 20, rolls on the surfaces 12,14. Further inflation causes further movement. The approximate useful limit of travel is shown in FIG. **5*d*. The helicopter has now been moved to the left, and to complete the cycle of movement the bags 9 are vented so that the load is transferred from the shoes 6 back onto the skids 2 and the shoes 6 are brought back to their initial position relative to the skids 2 by the spring 24**.

The separation between the surfaces 12,14 when the bags are inflated depends on the extent of yielding of the ground under the shoe 6, as well as on the relative horizontal displacement of the shoe 6 and the skid 2. On soft and yielding ground the system will continue to work so long as enough of the bag remains in contact with the surfaces 12,14 to provide the required force within the limits of available air pressure. FIG. **5*e*** illustrates a situation in which the ground has yielded and insufficient force is developed to provide motion.

The compressed air supply for the inflatable bags may be located on or off the helicopter, or may be derived from the air bleed from the drive turbine of the aircraft. The inflation and venting of the bags may be controlled by simple two-way valves, and automatic repetition of the cycle may be achieved using limit switches, e.g. electrical or pneumatic, which detect the relative movement of the skid and the shoe.

To move the helicopter to the right (in FIG. 2) the bags 10 are used in the same way. By suitable control of the inflation of the various bags, it is possible to turn and steer the aircraft. This may be done for example by throttling the air supply to bags on one side of the undercarriage to restrict the speed of movement of that side, and arranging for both shoes 6 to return to their starting positions when either of them reaches the limit of its travel. Thus one shoe moves a shorter distance than the other in each cycle of operation.

The controls can be either inside the helicopter, or outside it for operation by a man walking beside the aircraft where he may have the best possible view of obstacles.

The asymmetry of the arrangement as seen in FIG. 2 about a vertical plane perpendicular to the paper should be particularly noted; if the construction were in the form of a mirror image about the vertical pane at the position of the return spring 24, and the positions of the bags 8 and 10 on for instance the right of the spring 24 were interchanged, the resultant lift force would not act through the centre of the skid, and this would increase the tendency of the skids to lift at one end when the centre of gravity of the helicopter was near an extreme position. It in some cases is desirable to make provision for cutting off (or reducing the pressure in) bags at one end or the other of the skid, in order to bring the effective lift more nearly into coincidence with the centre of gravity of the helicopter.

The weight of the helicopter may vary typically by a factor of about two between the laden and the unladen conditions, and the force required to slide it on its skids by a factor of, for example, about six, depending on both the weight and the ground conditions. The arrangement of the invention applies an inclined force with a constant ratio of horizontal and vertical components, so that it can operate over a wide variety of loads, with high stability in all cases since the skids 2 are not lifted off the ground.

What is claimed is:

1. A helicopter undercarriage comprising a pair of spaced apart generally parallel ground-contacting skids, two transport shoes respectively associated with said skids, and movable horizontally and vertically with respect to the associated skid, on each said skid, at least two downwardly facing surfaces both generally inclined to the horizontal, and relatively spaced apart longitudinally of the skid, on each said shoe, at least two upwardly facing surfaces generally inclined to the horizontal and respectively opposed to said at least two downwardly facing surfaces of the associated skid, an inflatable flexible bag located between each said downwardly facing surface and the respective opposed upwardly facing surface, each said bag being capable of rolling on said surfaces when they move horizontally relative to each other, the said bags when inflated applying horizontal and vertical force simultaneously so as to urge the skids and transport shoes apart, so that when friction between the skids and the ground is overcome the skids slide across the ground thereby transporting the helicopter across the ground, while each bag rolls on the said surfaces between which it is located, each said bag comprising an inner inflatable chamber and an outer inflatable chamber in the form of a tube extending around said inner chamber and lying between the inner chamber and the said surfaces between which the bag is located, and means for returning the transport shoes to their initial positions with respect to the skids when the bags are deflated following their inflation and the consequent sliding movement of the skids.

2. A self-transporting support arrangement for supporting a load on a base surface comprising:

at least one support member engageable with the base surface to support the load and suitably shaped to slide across the base surface; and at least one transport shoe also engageable with the base surface and movable vertically and horizontally with respect to the support member, said support member having at least two downward facing surfaces and said transport shoe having at least two upward facing surfaces, which surfaces are arranged as two pairs of mutually opposed surfaces, said surfaces being generally sloping with respect to the horizontal, an inflatable flexible bag located between the downward and upward facing surfaces of each said pair of mutually opposed sloping surfaces, each said bag being capable of rolling on said pair of opposed sloping surfaces between which it is located when these surfaces move horizontally relative to each other, each said bag being thus arranged on being inflated to apply horizontal and vertical force simultaneously so as to urge the support member and the shoe apart, whereby when friction acting between the support member and the base surface is overcome the support member slides across the base surface with the load it is supporting while the bag rolls on said pair of opposed surfaces between which it is located, the arrangement being such that by means of said surfaces and said bags the support member is movable in first and second mutually opposite directions, and the said pairs of surfaces and said bags being so located and arranged that the resultant lift force applied to the support member when the support member is moved in either said first or said second direction is located substantially at the same vertical plane which plane is perpendicular to said first and second directions.

3. A self-transporting support arrangement according to claim 2, wherein the said surfaces in each said pair of opposed surfaces are planar and are parallel to each other.

4. A self-transporting support arrangement according to claim 2, wherein there are four of said pairs of opposed surfaces of the support member and said transport shoe, the pairs being spaced apart longitudinally in said first direction, a first two of said four pairs being downwardly sloping in said first direction and the other two of said four pairs being downwardly sloping in said second direction and both located longitudinally between said first pairs.

5. A self-transporting support arrangement according to claim 2, having means separate from said inflatable bags for returning said transport shoe to its initial position, following the sliding movement of the support member caused by inflation of the bag.

6. A self-transporting support arrangement according to claim 2 wherein the support member is elongate and has opposite longitudinal ends and a longitudinal axis extending from a first said end to a second said end, said transport shoe being located on said longitudinal axis and between said first and second ends.

7. A self-transporting support arrangement according to claim 2 wherein each said bag has a plurality of chambers.

8. A self-transporting support arrangement according to claim 2 wherein each said bag has an inner chamber and an outer chamber in the form of a tube extending around the inner chamber and lying between the inner chamber and said opposed surfaces of the support member and the transport shoe.

9. A self-transporting support arrangement according to claim 8 wherein said first and second chambers are in open communication with each other.

10. A helicopter undercarriage comprising at least one self-transporting support arrangement according to claim 2.

11. In a self-transporting support arrangement for supporting a load on a ground surface, wherein a ground-engageable transport shoe applies vertical and horizontal force to a ground-engageable support member bearing the load so as to cause said support member to slide across the ground surface when friction is overcome, said force being applied by means of inflatable bags located between mutually opposed sloping surfaces of respectively the support member and the transport shoe, the improvement of providing between the support member and the transport shoe at least two of said inflatable bags and arranging the bags and the said opposed surfaces between which the bags are located so that the support member can be moved in a forward direction and in a reverse direction opposite said forward direction, with the resultant vertical lift force applied to the support member being located at substantially the same position relative to the support member when the support member is moved in the forward direction and in the reverse direction.

12. A self-transporting support arrangement for supporting a load on a base surface comprising:

at least one support member engageable with the base surface to support the load and suitably shaped to slide across the base surface; and at least one transport shoe also engageable with the base surface and movable vertically and horizontally with respect to the support member, said support member having a downward facing surface generally inclined to the horizontal and said transport shoe having an upward facing surface generally inclined to the horizontal and opposed to said surface of the support shoe, and there being an inflatable flexible bag located between said surfaces of the support member and the transport shoe and capable of rolling on said surfaces when said surfaces move horizontally relative to each other, said bag having a plurality of chambers, comprising an inner chamber and an outer chamber in the form of a tube extending around the inner chamber and lying between the inner chamber and said opposed surfaces of the support member and the transport shoe, said bag being arranged on being inflated to apply horizontal and vertical force simultaneously so as to urge the support member and the shoe apart, whereby when friction acting between the support member and the base surface is overcome the support member slides across the base surface with the load it is supporting while the bag rolls on said opposed surfaces of the support member and the transport shoe.

13. A self-transporting support arrangement according to claim 12, wherein said first and second chambers are in open communication with each other.

14. A self-transporting support arrangement for supporting a load on a base surface, having:

at least one support member engageable with the base surface to support the load and suitably shaped to slide across the base surface; and at least one transport shoe also engageable with the base surface and movable vertically and horizontally with respect to the support member;

said support member having at least one first downward facing surface generally sloping downwardly with respect to the horizontal in a first direction and at least one second downward facing surface generally sloping downwardly with respect to the horizontal in a second direction which is different from said first direction, and said transport shoe correspondingly having first and second upward facing surfaces generally sloping with respect to the horizontal in respectively said first and second directions and respectively opposed to said first and second downward facing surfaces of the support shoe; and there being an inflatable flexible bag located between each of said downward facing surfaces of the support member and the respective upward facing surface of the transport shoe opposed thereto, each said bag being capable of rolling on said surfaces between which it is located when said surfaces move horizontally relative to each other, each said bag being thus arranged on being inflated to apply horizontal and vertical force simultaneously so as to urge the support member and the shoe apart, whereby when friction acting between the support member and the base surface is overcome the support member slides across the base surface with the load it is supporting while the bag rolls on said opposed surfaces of the support member and the transport shoe, said first surfaces and the bag located between them thus causing movement of the support shoe in said first direction and said second surfaces and the bag located between them thus causing movement of the support shoe in said second direction.

* * * * *